United States Patent [19]

Moloney

[11] 4,446,966

[45] May 8, 1984

[54] PRINTED CIRCUIT BOARD CONTAINER CARRYING CASE

[75] Inventor: Donald J. Moloney, Wilmette, Ill.

[73] Assignee: Knickerbocker Case Company, Chicago, Ill.

[21] Appl. No.: 498,938

[22] Filed: May 27, 1983

[51] Int. Cl.[3] ..... B65D 85/30; B65D 5/48; B65D 57/00; A47G 19/08

[52] U.S. Cl. ..... 206/334; 211/41; 217/7; 220/22; 206/454; 206/499

[58] Field of Search ..... 206/454, 455, 456, 310, 206/370, 334, 328, 499; 312/10; 211/41; 217/7; 220/22, 20

[56] References Cited

U.S. PATENT DOCUMENTS

| | | | |
|---|---|---|---|
| 1,030,534 | 6/1912 | Pooler | 206/310 |
| 2,112,498 | 3/1938 | Lax | 217/7 |
| 2,718,326 | 9/1955 | LeBlanc | 217/7 |
| 2,868,606 | 1/1959 | Stierna | 206/310 |
| 3,409,861 | 11/1968 | Barnes et al. | 339/174 |
| 3,760,486 | 9/1973 | Rifkin et al. | 29/278 |
| 3,777,882 | 12/1973 | McIntyre | 206/370 |
| 4,026,412 | 5/1977 | Henson | 206/331 |
| 4,029,208 | 6/1977 | Fickler | 206/454 |
| 4,061,228 | 12/1977 | Johnson | 206/454 |
| 4,143,763 | 3/1979 | Hoglund | 206/334 |
| 4,155,447 | 5/1979 | Edwards | 206/334 |
| 4,261,464 | 4/1981 | Maitland | 206/334 |
| 4,261,465 | 4/1981 | Thomas | 206/334 |
| 4,308,953 | 1/1982 | Cohen | 206/334 |

*Primary Examiner*—William T. Dixson, Jr.
*Attorney, Agent, or Firm*—Silverman, Cass & Singer, Ltd.

[57] ABSTRACT

A container for retaining printed circuit (PC) cards is provided with transverse and longitudinal dividers positioned respectively in upper and lower levels of the container base. The interior of the base, formed like an open top box, is lined on its side, front and rear walls with panels providing regularly spaced apart slots. The sides of the dividers also carry the panels of regularly spaced apart slots. The transverse dividers extend between the side walls while the longitudinal dividers extend between the front and rear walls with the ends of the dividers being retained in the wall slots. The transverse and longitudinal dividers are arranged in the base perpendicular to one another and are selectively insertable in the wall slots adjustably to retain PC cards of various lengths and widths therebetween.

5 Claims, 3 Drawing Figures

FIG. 1
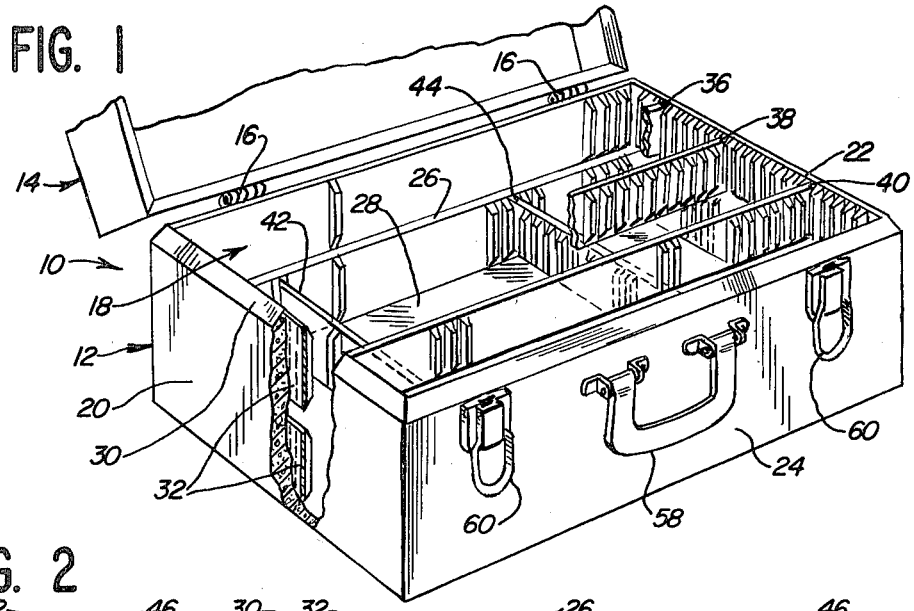
FIG. 2
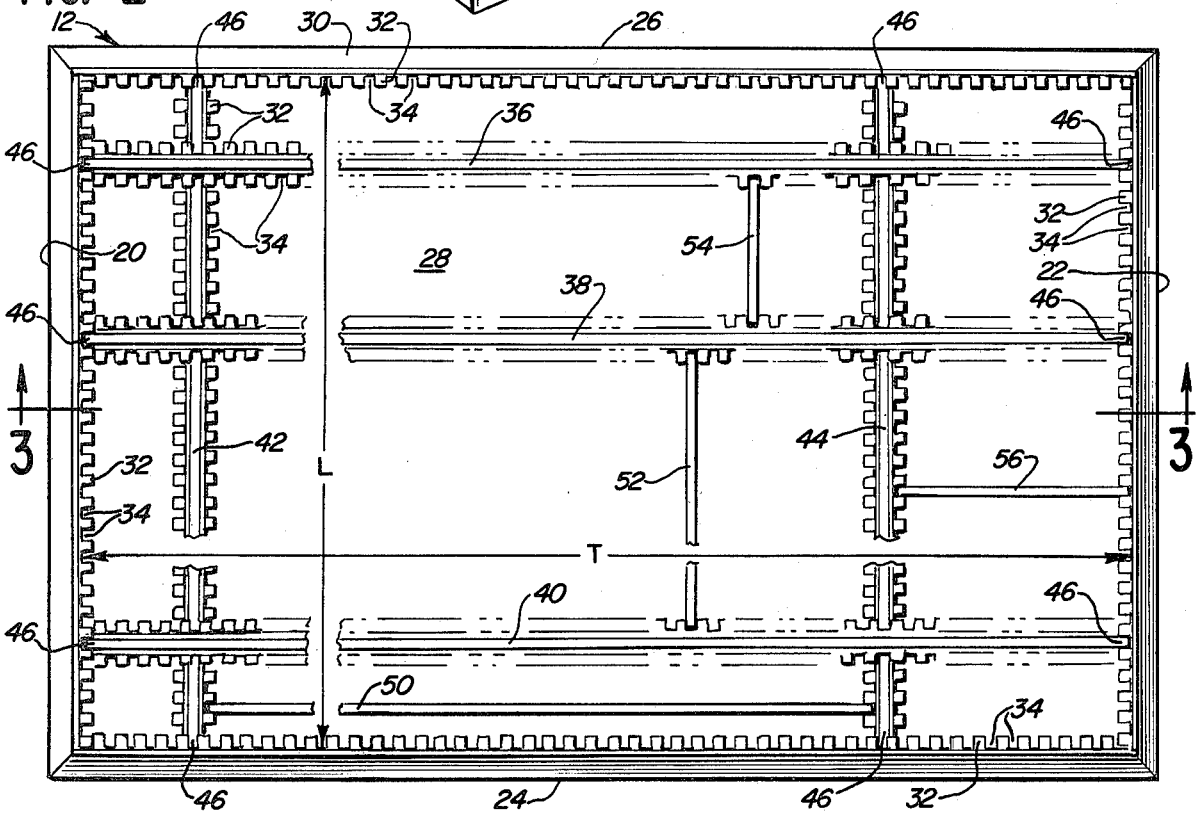
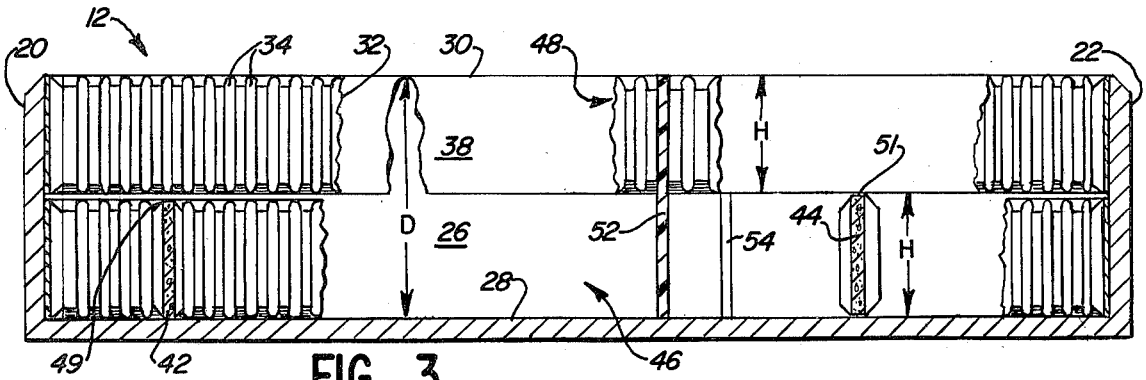
FIG. 3

PRINTED CIRCUIT BOARD CONTAINER CARRYING CASE

BACKGROUND OF THE INVENTION

This invention relates generally to printed circuit card carrying, shipping and storage containers and in particular relates to hand-held carrying cases for printed circuit cards of the type typically carried by a technician-repairman to and from a field repair site.

Known printed circuit card carrying cases of the type indicated resemble large brief cases or sample cases. Internally, the lower portion of the case is lined on its four sides with slotted panels that accept dividers also carrying slotted panels. The dividers are arranged in the cases either front to back or side to side and at desired distances and the circuit cards are held at their margins against lateral movement by the slots of the panels. Closing the case top retains the cards vertically in the slots. Alternatively, dividers shorter than the front to rear distance of the case are provided to sub-divide the space between such as the front of the case and a side to side divider located median of the case. An example of such a container case used for storage is described in U.S. Pat. No. 4,308,953.

These arrangements of dividers are necessary to accommodate the multitude of lengths of printed circuit boards, which are manufactured to fit their application and not a standard sized carrying or storage case. Thus, the dividers of printed circuit card carrying and storage cases must be selectively insertable in the panel slots of the case to accommodate the various lengths of printed circuit cards.

SUMMARY OF THE INVENTION

In accordance with the invention there is provided a container or case for keeping printed circuit (PC) cards in fixed positions relative to the walls and dividers of the case to avoid damaging components carried on the PC cards. The dividers are arranged at two distinct and separate levels in the case to obtain a greater adjustability of positions for accommodating PC cards of various lengths and widths.

The case is in the form of an open top box having front, rear and side and bottom walls spaced from one another. The side walls are spaced apart a transverse distance. The front and rear walls are spaced apart a longitudinal distance and the bottom is spaced downward at a depth from the top margin of the side, front and rear walls. The interiors of the side, front and rear walls are lined or carry panels having regularly spaced apart slots.

Two different length types of planar dividers are used in the case. The transverse dividers have lengths slightly less than the transverse distance between side walls and the longitudinal dividers have lengths slightly less than the longitudinal distance between the front and rear walls. Otherwise, the dividers are identical. They have end portions that are inserted in the panel slots, they carry panels having regularly spaced apart slots and they have heights that are approximately one half the depth of the case.

The dividers are inserted in the case at one of two levels, an upper level and a lower level. The dividers that are inserted in the case at or in the lower level rest on the bottom wall and provide support for the dividers inserted in the case at or in the upper level. The dividers in the upper level are arranged perpendicular to the dividers in the lower level and rest thereon. All of the transverse dividers are inserted in one level while the longitudinal dividers are inserted in the other level.

The transverse dividers are inserted in the case in parallel with the front and rear walls and normal to the side walls at or in one level. The longitudinal dividers are inserted in the case in parallel with the side walls and normal to the front and rear walls at or in another level, perpendicular to the transverse dividers.

The dividers in both levels then are spaced from one another and the side, front and rear walls to accommodate, keep or retain the PC cards of various lengths and widths in the panel slots while the PC cards simultaneously rest on the bottom wall.

This dimensioning and positioning of walls and dividers provides a container having only two types of dividers and that readily is adjustable in several directions simultaneously to accommodate several different sized PC cards at the same time. Further, the same container instantly is adjustable, even in the field, to accommodate another different sized PC card without the need for a possibly unavailable additional type of divider of a different length. The invention is applicable to containers used for carrying, sorting and shipping PC cards. Adjustability occurs by selectively inserting the divider end portions in different panel slots.

BRIEF DESCRIPTION OF THE DRAWING

FIG. 1 is a perspective view of a container carrying case, partly in section, constructed and arranged according to the invention;

FIG. 2 is a plan view of the base of the container carrying case showing the placement of several printed circuit cards between the dividers; and FIG. 3 is a side sectional view of the base taken along the lines 3—3 of FIG. 2 and in the direction shown.

DESCRIPTION OF THE PREFERRED EMBODIMENT

In FIG. 1, the container carrying case of the invention is indicated generally by the reference character 10. Case 10 resembles a large brief case and comprises a base 12 and a cover 14 joined together by such as hinges 16. When the cover is closed over the base, they mate to form an enclosed chamber 18 in which the PC cards are placed and retained.

Base 12 is like an open top box and comprises opposed side walls 20, 22; front and rear walls 24, 26 and a bottom wall 28, see also FIGS. 2 and 3. Side walls 20, 22 are located a transverse distance "T" from one another. Front and rear walls 24, 26 are located a longitudinal distance "L" from one another and bottom 28 is located at a depth "D" from a top margin 30 of the side, front and rear walls. The side, front and rear walls are formed of any material desired such as composition board. The interiors of the side, front and rear walls are lined with or carry panels 32 of plastic or other material which provide regularly spaced apart vertical slots 34.

Transverse dividers 36, 38 and 40 and longitudinal dividers 42 and 44 all have end portions 46 that mate with and are inserted into the slots 34. All of the dividers are similar in that they are planar members formed of any stiff material desired such as composition board and carry on their sides the panels 32 providing the regularly spaced apart slots 34. Further, all of the dividers 36, 38, 40, 42 have a height "H" approximately equal to one half (½) the depth "D" of the base 12. See FIG. 3.

Transverse dividers 36, 38 and 40 have lengths slightly less than said transverse distance "T" and thus differ from the longitudinal dividers 42 and 44, which have lengths slightly less than said longitudinal distance "L". Thus, the dividers will not bind in the slots when inserted in the case.

Transverse dividers 36, 38 and 40 are inserted in the case 10 parallel to the front and rear walls 24 and 26 and normal to the side walls 20, 22. Longitudinal dividers 42 and 44 are inserted in the case 10 parallel to the side walls 20, 22 and normal to the front and rear walls 24, 26.

Longitudinal dividers 42 and 44 are positioned at a lower level 46 resting on the bottom wall 28 of the base 12 while the transverse dividers 36, 38 and 40 are positioned at an upper level 48 resting on top of the longitudinal dividers such as 49, 51 and perpendicular thereto. Thus arranged, the dividers 36, 38, 40, 42 and 44 retain or keep fixed in the base 12, a variety of PC cards such as cards 50, 52, 54 and 56 in the slots 34 of the panels 32. In FIG. 3, it is seen that the cards 52 and 54 extend downward and rest on the bottom wall 28. Alternatively, the positions of the dividers in the upper and lower levels can be interchanged.

The advantage of the case 10 is that only two types of dividers, transverse and longitudinal, need be manufactured for use therein to retain or keep fixed a multitude of PC cards of various lengths and widths. The positions of the dividers readily and instantly are changed or adapted to accommodate different sized cards without the need for different sized dividers. Further, these changes can occur at a field site where no alternate sized dividers are available. In a carrying case configuration, closing the cover 14 locks the PC cards in vertical position between the cover 14 and bottom wall 28.

The base further is provided on the exterior of the front wall 24 with a handle 58 and two latches 60 that interlock with matching hardware on the cover 14. This facilitates hand carrying of the case 10.

The panels 32 are shown as having heights approximately equal to half the depth of case 10. So dimensioned, they can be molded in extended lengths and cut to desired sizes. Alternatively, the panels are formed of material having a height equal to the depth of case 10 and are provided with double rows of slots. Thus formed, the panels are split in half longitudinally for application to the dividers.

The invention may be used in containers for PC cards other than carrying cases as is desired, such as in storage and shipping containers, and a plurality of arrangements of the transverse and longitudinal dividers is available for keeping or retaining PC cards therein.

I claim:

1. A container for retaining printed circuit cards of various lengths and widths, comprising:

a base providing an open top box formed by opposed side walls spaced a transverse distance apart, opposed front and rear walls spaced a longitudinal distance apart and a bottom wall extending between all the side, front and rear walls at a depth from the top margin thereof, the side, front and rear walls being lined internal of the base with panels providing regularly spaced apart slots, the panels extending substantially from the wall top margin to the bottom wall; and a plurality of transverse and longitudinal planar dividers having end portions inserted in said wall carried panel slots, said dividers carrying panels providing regularly spaced apart slots and having heights equal substantially to one half of said depth, the transverse dividers having lengths equal to said transverse distance and the longitudinal dividers having lengths equal to said longitudinal distance, the transverse dividers being positioned in said base between said side walls at one of a lower and upper level and the longitudinal dividers being positioned in said base between said front and rear walls at the other of said levels;

so that said dividers selectively are inserted in said base to retain printed circuit cards of various lengths and widths in said slots.

2. The container of claim 1 further including a cover joined to the base along the rear wall and when closed on the open top of the base, mating therewith to form an enclosed chamber.

3. The container of claim 1 in which the dividers in said lower level rest on said base and provide support for the dividers in said upper level and the dividers in said upper level rest on and are arranged perpendicular to the dividers in the lower level.

4. The container of claim 1 in which the transverse dividers are inserted in the base parallel to the front and rear walls and normal to the side walls and the longitudinal dividers are inserted in the base parallel to the side walls and normal to the front and rear walls.

5. The container of claim 1 in which the transverse dividers are positioned in the base in the upper level and the longitudinal dividers are positioned in the lower level.

* * * * *